US005839978A

United States Patent [19]

Evangelist

[11] Patent Number: 5,839,978

[45] Date of Patent: Nov. 24, 1998

[54] BASEBALL TRAINING DEVICE FOR PROPER HITTING MOVEMENT SEQUENCE

[76] Inventor: Matthew J. Evangelist, 1236 Harrison St., Philadelphia, Pa. 19124

[21] Appl. No.: 881,669

[22] Filed: Jun. 24, 1997

Related U.S. Application Data

[63] Continuation of Ser. No. 647,305, May 9, 1996, abandoned.

[51] Int. Cl.[6] ..... A63B 69/40

[52] U.S. Cl. ..... 473/458; 119/819; 128/869

[58] Field of Search ..... 473/207, 217, 473/218, 270, 271, 272, 458, 452; 119/814, 862, 816, 819, 782, 712; 70/16, 18; 128/869, 882; 434/252, 255

[56] References Cited

U.S. PATENT DOCUMENTS

| | | | |
|---|---|---|---|
| 119,865 | 7/1871 | Paulson | 119/811 |
| 267,877 | 11/1882 | Gustaveson | 119/819 |
| 705,556 | 7/1902 | Bostwick | 119/819 |
| 953,818 | 5/1910 | Chambers | 119/819 |
| 1,677,728 | 7/1928 | Robinson | 273/188 A |
| 4,088,326 | 5/1978 | Bifulco | 273/188 R |
| 4,239,228 | 12/1980 | Norman et al | 473/212 |
| 4,706,957 | 11/1987 | Jackson | 273/188 R |
| 4,757,995 | 7/1988 | Gallagher | 473/458 |
| 4,955,608 | 9/1990 | Dougherty et al | 273/29 A |
| 5,016,885 | 5/1991 | Quigly | 273/188 R |
| 5,114,142 | 5/1992 | Gillespie et al | 273/26 C |

*Primary Examiner*—Theatrice Brown
*Attorney, Agent, or Firm*—Patent & Trademark Services; Joseph H. McGlynn

[57] ABSTRACT

A sport training device which has a pair of straps which are secured around the user's ankles. The straps are connected by a resilient band and the straps have a tab which folds over the strap to secure the straps and prevent accidental disengagement of the straps.

3 Claims, 1 Drawing Sheet

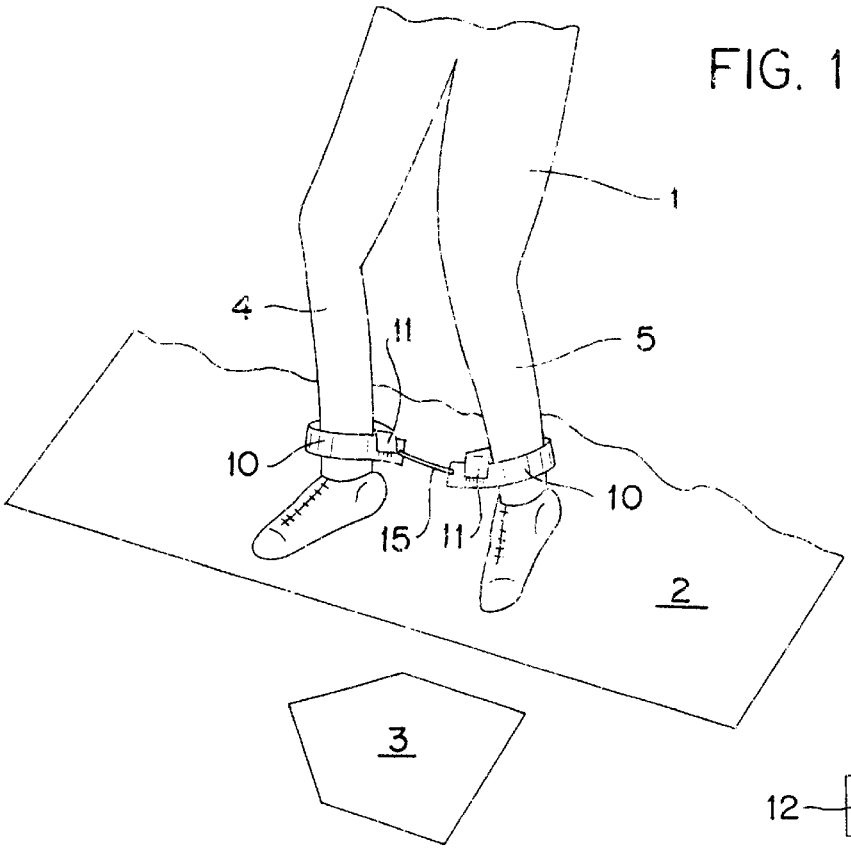
FIG. 1
FIG. 2
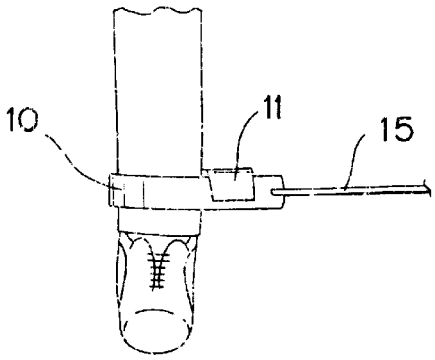
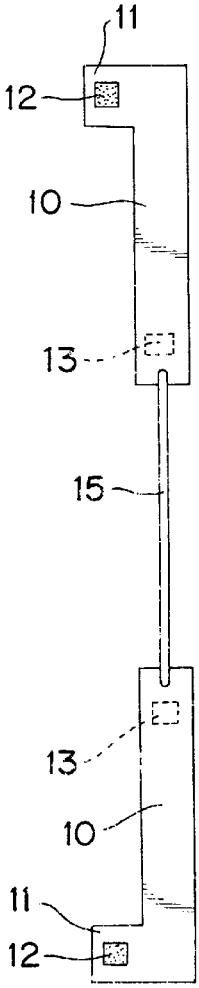
FIG. 3

BASEBALL TRAINING DEVICE FOR PROPER HITTING MOVEMENT SEQUENCE

This application is a continuation of application Ser. No. 08/647,305, filed May 9, 1996, now abandoned.

BACKGROUND OF THE INVENTION

This invention relates, in general, to baseball training devices, and, in particular, to a training aid that provides optimal stride and body movement sequence for the efficient hitting of a baseball.

DESCRIPTION OF THE PRIOR ART

In the prior art various types of training devices have been proposed, however all of the prior art devices have been so constraining that the user loses concentration on what is the proper training movement, and/or the devices restrict the user's movements to such an extent that he/she may lose their balance which could result in injury.

SUMMARY OF THE INVENTION

The present invention provides a sport training device which has a pair of straps which are secured around the user's ankles. The straps are connected by a resilient band and the straps have a tab which folds over the strap to secure the straps and prevent accidental disengagement of the straps.

It is an object of the present invention to provide a new and improved sports training device that trains a user in the proper hitting movement sequence.

It is an object of the present invention to provide a new and improved sports training device that allows for unrestricted movement of the user away from inside pitches.

It is an object of the present invention to provide a new and improved sports training device that adjusts to the individual stride adjustment for different batters.

It is an object of the present invention to provide a new and improved sports training device that provides a simple, durable, inexpensive device that is easily transportable.

It is an object of the present invention to provide a new and improved sports training device that is adjustable to different size user's.

These and other objects and advantages of the present invention will be fully apparent from the following description, when taken in connection with the annexed drawings.

BRIEF DESCRIPTION OF THE DRAWINGS

FIG. 1 is view of the present invention when positioned on the ankles of a user.

FIG. 2 is a enlarged view of one of the straps of the present invention.

FIG. 3 is a plan view of the straps of the present invention.

DESCRIPTION OF THE PREFERRED EMBODIMENT

Referring now to the drawings in greater detail, FIG. 1 shows a user 1 standing in a baseball/softball batters box 2 which is properly positioned next to home plate 3. Secured around the ankles of the user is the present invention 10, 11, 15. The present invention comprises a pair of ankle straps 10 (see FIGS. 2 and 3) which can be made from any durable material such as, but not limited to, canvas or Nylon.

Attached to each strap 10 is an elastic band 15 which can be secured thereto in any conventional manner. Each of the straps 10, as can be clearly seen in FIG. 3 consists of a main rectangular section and a right angle tab section 11. The tab section 11 is preferably unitary with the main section, although it could be made as a separate piece and secured to the main section without departing from the scope of the invention.

The main section of each strap 10 has a fastener 13 attached adjacent one end of the strap, and the tab section 11 has a complimentary fastener 12 attached thereto. As clearly seen in FIG. 3, the fastener 13 is secured to one side of the strap and the fastener 12 is secured to an opposite side which has the tab 11.

As can be seen in FIGS. 1 and 2, when the strap 10 is wrapped around each ankle, the tab 11 will be folded over the strap and be secured, by means of the fasteners 12, 13, to the outside surface of the strap 10. This will securely fasten the strap around the ankles of the user during use, and will prevent the straps form accidentally coming off and possibly injuring the user. The preferred fasteners used with the present invention are Velcro hook and loop fasteners, however, other types of fasteners could be used.

If the fasteners 12, 13 were both attached to an inside portion of the band 10, the device would function as intended as long as the batter's front leg 4 moved in a straight line away from the back leg 5 as he/she engaged in a proper hitting sequence. However, if the batter's front leg 4 did not move in a straight line away from the back leg 5 (i.e. if the batter stepped laterally away from the plate 3 to avoid an inside pitch) the movement would tend to separate the Velcro hook and loop fasteners 12, 13.

However, with the tabs 11 of the present invention, if the batter stepped laterally away from the plate 3 to avoid an inside pitch, the tab 11 will hold because the pressure on the front strap would not be in a direction to separate the Velcro hook and loop fasteners 12, 13. Therefore, there is little if any chance that the straps 10 will come off during movement of the batter's legs, and the chance of injury to the batter will be greatly reduced.

In use, the straps 10 are wrapped around each ankle of the batter, as shown in FIGS. 1 and 2. The tabs 11 are folded over the top of the strap and secured by means of the fasteners 12, 13. With the batter's feet restrained in their movement by the straps 10 and the resilient strap 15, proper hitting technique can be practiced. The present invention shortens the batter's stride, which facilitates proper batting movements and allows the batter's hips to rotate automatically while minimizing improper body and head movement. Concentration can be maximized on proper hip and head movement while maintaining eye contact with the ball.

Proper batting techniques begin with a stride forward towards the oncoming ball. The stretchable or resilient band 15 is secured to the batter's ankles during practice, and as the batter goes through the basic step and swing motion, the device shortens the stride of the batter, facilitates proper body movements and shortens the time to prepare for and to swing the bat. A shortened stride promotes proper hip rotation which in turn generates greater power in the swing. Less time in preparing to swing gives the batter a longer time to look at the pitch and determine the type of pitch and adjust accordingly.

Also, while the present invention has been describe as being used for baseball or softball, it could also be used in other sports where proper footwork is required. For example, the training device could be used for sports such as, but not limited to, tennis, hockey or lacrosse.

In addition, while the present invention has been described as being used with "live pitching", i.e. a ball thrown by a person or pitching machine, it should be understood that it could also be used to train batters while using a batting tee or any other device that does not require "live pitching".

Although the Baseball Training Device and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A baseball training device adapted to be secured around a user's ankles, said training device comprising:

a pair of straps, each strap being defined by an elongated main section said tab section being integral with one end of and substantially perpendicular to said main section, and a tab section, each said main section having a first fastener portion attached adjacent its other end, each said tab section a second fastener portion complementary to said first fastener portion and attached thereof;

a resilient band having opposite ends, each of said ends being secured respectively to the other end of a main section.

2. The training device as claimed in claim 1, wherein each of said main sections has a first surface and an opposite second surface, said first surface being adapted to be in contact with a user's ankle, said opposite second surface being on an opposite side of said strap from said first surface, said first fastener portion on said main section being attached to said opposite second surface, each said tab section has a first surface and an opposite second surface which are coextensive with said first and second surface of said main section, said complimentary second fastener portion on said tab section being attached to said first fastener portion on said main section.

3. The training device as claimed in claim 1, wherein one of said fastener portions is a Velcro hook and the other fastener portion is Velcro.

* * * * *